US005980315A

United States Patent [19]

Matsuda et al.

[11] Patent Number: 5,980,315

[45] Date of Patent: Nov. 9, 1999

[54] CONNECTOR FOR A COAXIAL CABLE

[75] Inventors: Nobuyoshi Matsuda; Takayoshi Kanda, both of Itami, Japan

[73] Assignee: Mitsubishi Cable Industries, Ltd., Hyogo-ken, Japan

[21] Appl. No.: 08/873,755

[22] Filed: Jun. 12, 1997

[30] Foreign Application Priority Data

Jun. 21, 1996 [JP] Japan ..... 8-161893
Feb. 13, 1997 [JP] Japan ..... 9-028674

[51] Int. Cl.[6] ..... H01R 9/05
[52] U.S. Cl. ..... 439/583
[58] Field of Search ..... 439/583, 584, 439/578

[56] References Cited

U.S. PATENT DOCUMENTS 4,046,451 9/1977 Juds et al. ..... 439/583
5,318,458 6/1994 Thorner ..... 439/584
5,722,855 3/1998 Kanda et al. ..... 439/578

FOREIGN PATENT DOCUMENTS 1-13334 4/1989 Japan .
1-15083 5/1989 Japan .
8-78105 3/1996 Japan .
8-227764 9/1996 Japan .

*Primary Examiner*—Gary F. Paumen
*Attorney, Agent, or Firm*—Sixbey, Friedman, Leedom & Ferguson, P.C.; Eric J. Robinson

[57] ABSTRACT

A connector for a coaxial cable is provided which has been miniaturized for facilitating its handling and storage, and also for reducing the cost and the number of its electric contact points. The cylindrical connector main body is fitted onto the end of the coaxial cable and secured thereto. In this case, the split clamp which is fitted around the external conductor is engaged in the concave stage portion so as to expose the edge of the external conductor. Hexagon socket head cap screws are screwed into the attachment holes so as to incorporate the contact spacer into the connector main body. As a result, the edge of the external conductor is bent on the outer side along the split clamp to form a flare unit, which is contacted and pressed against the base end surface of the contact spacer and electrically connected. The central contact is made up of a bar-like member integral with the anchor unit with grooves and the male thread unit in order to reduce its size in the cable axis X direction. The male thread unit is made to go through the inside hole of the contact spacer and screwed into a female thread unit of the internal conductor to connect them electrically. The connector is connected with another connector by connection volts which go through the connection holes.

8 Claims, 6 Drawing Sheets

CONNECTOR FOR A COAXIAL CABLE

BACKGROUND OF THE INVENTION

The present invention relates to a connector for being attached to the end of a coaxial cable composed of an internal conductor and an external conductor consisting of a corrugated tube.

A connector for a coaxial cable of this type has been disclosed in Japanese Laid-open Patent Application No. 8-78105 of which two inventors are the inventors of the present invention. This connector will be described as follows, making reference to the connectors a and a' shown in FIG. 6. Each of the connectors a and a' is composed of a first connection cylinder b which is fitted onto the outer surface of a coaxial cable 100, a tubular central contact c which is joined to the end of an internal conductor 101, and a second connection cylinder d which is placed coaxially with the central contact c and joined in series to the tip of the first connection cylinder b in such a manner as to protrude through the end of the coaxial cable 100. The central contact c is housed in the second connection cylinder d in a state where the central contact c is not in contact with the cylinder d, whereas the end of the external conductor 102 is contacted to the second connection cylinder d. While the connector a with such a construction is attached to the end of the coaxial cable 100, the other connector a' is attached to the end of another coaxial cable 100 as the connection target. Then, a connection is established between these connectors a and a' by means of a bar-like anchor connector f with connection portions e and e at its both, which is formed separately from these connectors. To be more specific, the flanges g and g of the second connection cylinders d and d of the connectors a and a' are contacted to each other so that the external conductors 102 and 102 are joined to each other, whereas the central contacts c and c of the connectors a and a' are connected with each other by means of the anchor connector f so that the internal conductors 101 and 101 are joined to each other.

However, since the connection between these conventional connectors a and a' is established by means of the anchor connector f, each connector is required to include the tubular central contact c for letting each end of the anchor connector f fit thereinto. Furthermore, each connector is required to make the second connection cylinder d long enough in the axial direction in order to cover the protruded portion of the central contact c and to let the flanges g and g be contacted to each other. For this reason, the whole length of each connector must be large in the axial direction, which increases its weight, making it troublesome to be handled or stored, and which also raises the cost. In addition, the electric connection between the internal conductors 101 are established by means of the contact points: the central contact c of the connector a, the anchor connector f, and the central contact c of the other connector a', so that the continuity resistance increases in proportion to the number of electric contact points.

SUMMARY OF THE INVENTION

The object of the present invention is to miniaturize a connector for a coaxial cable in order to facilitate its handling and storage, and also to reduce the cost and the number of its electric contact points.

The first invention is directed to a connector for a coaxial cable for being attached to the end of a coaxial cable which is composed of an internal conductor and an external conductor consisting of a corrugated tube. The connector for a coaxial cable of the first invention is composed of a connector main body, a contact spacer, and a central contact, which respectively have the following constructions.

The connector main body is cylindrical and its base end part is fitted onto the end of the coaxial cable in the cable axis direction and secured thereto.

The contact spacer is in the shape of a doughnut plate and includes an inside hole having a diameter smaller than the tip opening of the connector main body. The contact spacer is joined to the end surface of the connector main body on the tip opening side in such a manner as to be pressed against the end surface. As a result, the contact spacer is contacted and pressed against the edge of the external conductor so as to be electrically connected with the external conductor.

The central contact is in the shape of a bar, and its base end part goes through the inside hole of the contact spacer under an insulated condition, thereby being electrically connected with the internal conductor whereas its tip end part protrudes through the contact spacer outwards in the cable axis direction.

In the first invention, the connector main body is held at the end of the coaxial cable, and the contact spacer is joined to the end surface of the connector main body on the tip opening side. As a result, the contact spacer and the external conductor of the coaxial cable are electrically connected with each other. On the other hand, the base end part of the bar-like central contact goes through the inside hole of the contact spacer and is electrically connected with the internal conductor of the coaxial cable, whereas the tip end part of the central contact protrudes through the contact spacer outwards in the cable axis direction. Then, the bar-like central contact is fitted into a tubular central contact or the like provided to another connector attached to the end of another coaxial cable which is the connection target.

Thus, in the first invention, the use of the bar-like central contact makes it possible to form a conventional anchor connector and a tubular central contact which lets the anchor connector fit thereinto in one piece. Consequently, there is no need for making the tubular central contact protrude through the end of the coaxial cable, which substantially reduces the length of the entire connector in the cable axial direction. This length reduction brings about a drastic miniaturization, cost reduction, and facilitation of the handling and storing of the connector. Furthermore, the absence of the electric contact points between the conventional anchor connector and the tubular central contact for letting the anchor connector fit thereinto results in a decrease in the number of electric contact points between the two internal conductors. As a result, the electrically continuity performance in the connector connection parts is enhanced.

The second invention is directed to a connector for a coaxial cable for being attached to a coaxial cable which is composed of an internal conductor and an external conductor consisting of a corrugated tube. The connector for a coaxial cable of the second invention is composed of a connector main body, a split clamp, a contact spacer, a central contact, and an annular insulator, which respectively have the following constructions.

The connector main body is cylindrical and its base end part is fitted onto the end of the coaxial cable in the cable axis direction. The connector main body is provided with a concave stage portion formed around the edge of the inner surface on the tip opening side. The split clamp is composed of a pair of annular members each divided into arcs. The split clamp is attached around the outer surface of the end of the external conductor in such a manner as to be adjacent to a flare unit formed as a result of expanding the edge of the external conductor toward the outer side. Also, the split clamp is housed in the concave stage portion of the connector main body in order to prevent the split clamp from relatively moving inwards from the tip opening of the connector main body.

The contact spacer is in the shape of a doughnut plate and joined to the end surface of the connector main body on the tip opening side in such a manner as to be pressed against the end surface, so that the flare unit is pressed between the split clamp and the contact spacer, thereby being electrically connected with the external conductor. The central contact is in the shape of a bar, and its base end part goes through the inside hole of the contact spacer, thereby being electrically connected with the internal conductor whereas its tip end part protrudes through the contact spacer outwards in the cable axis direction.

The annular insulator is disposed between the outer surface of the central contact and the inner surface of the contact spacer so as to insulate them.

In the second invention, the connector main body is held at the end of the coaxial cable, the split clamp is attached around the outer surface of the external conductor behind the flare unit, and the contact spacer is joined to the end surface of the connector main body on the tip opening side in such a manner as to be pressed against the end surface. In this condition, the split clamp is housed in the housing hole (the concave stage portion) of the connector main body on the tip opening side, thereby being prevented from moving inwards in the cable axis direction, so that the flare unit is disposed between the split clamp and the contact spacer, and contacted and pressed against them. As a result, it is secured that the external conductor of the coaxial cable and the contact spacer are electrically connected with each other.

On the other hand, the base end part of the bar-like central contact goes through the inside hole of the contact spacer and is electrically connected with the internal conductor of the coaxial cable, so that the tip end part of the central contact protrudes through the contact spacer outwards in the cable axial direction. In this case, because of the disposition of the annular insulator between the inside hole of the contact spacer and the outer surface of the central contact which goes through the inside hole, it becomes sure that the contact spacer on the external conductor side is insulated from the central contact on the internal conductor side. The bar-like central contact is fitted into a tubular central contact or the like which is provided to another connector attached to the end of another coaxial cable which is the connection target.

Thus, in the second invention, the same as in the first invention, the use of the bar-like central contact makes it possible to combine a conventional anchor connector and a tubular central contact which lets the anchor connector fit thereinto in one piece. Consequently, there is no need for making the tubular central contact protrude through the end of the coaxial cable, which substantially reduces the length of the entire connector in the axial direction.

This reduction in length brings about a drastic miniaturization, cost reduction, and facilitation of the handling and storing of the connector. Furthermore, the absence of the electric contact points between the conventional anchor connector and the tubular central contact for letting the anchor connector fit thereinto results in a decrease in the number of electric contact points between the two internal conductors. As a result, the continuity performance in the connector connection parts is improved.

Furthermore, in the second invention the disposition of the split clamp makes it sure that the external conductor of the coaxial cable and the contact spacer are electrically connected with each other. In addition, the disposition of the annular insulator makes it sure to insulate the contact spacer on the external conductor side and the central contact on the internal conductor side from each other under a condition where the central contact is firmly sustained.

DETAILED DESCRIPTION OF THE PREFERRED EMBODIMENTS

The embodiments of the present invention will be described based on the drawings.

<Embodiment 1>

Figure 1:
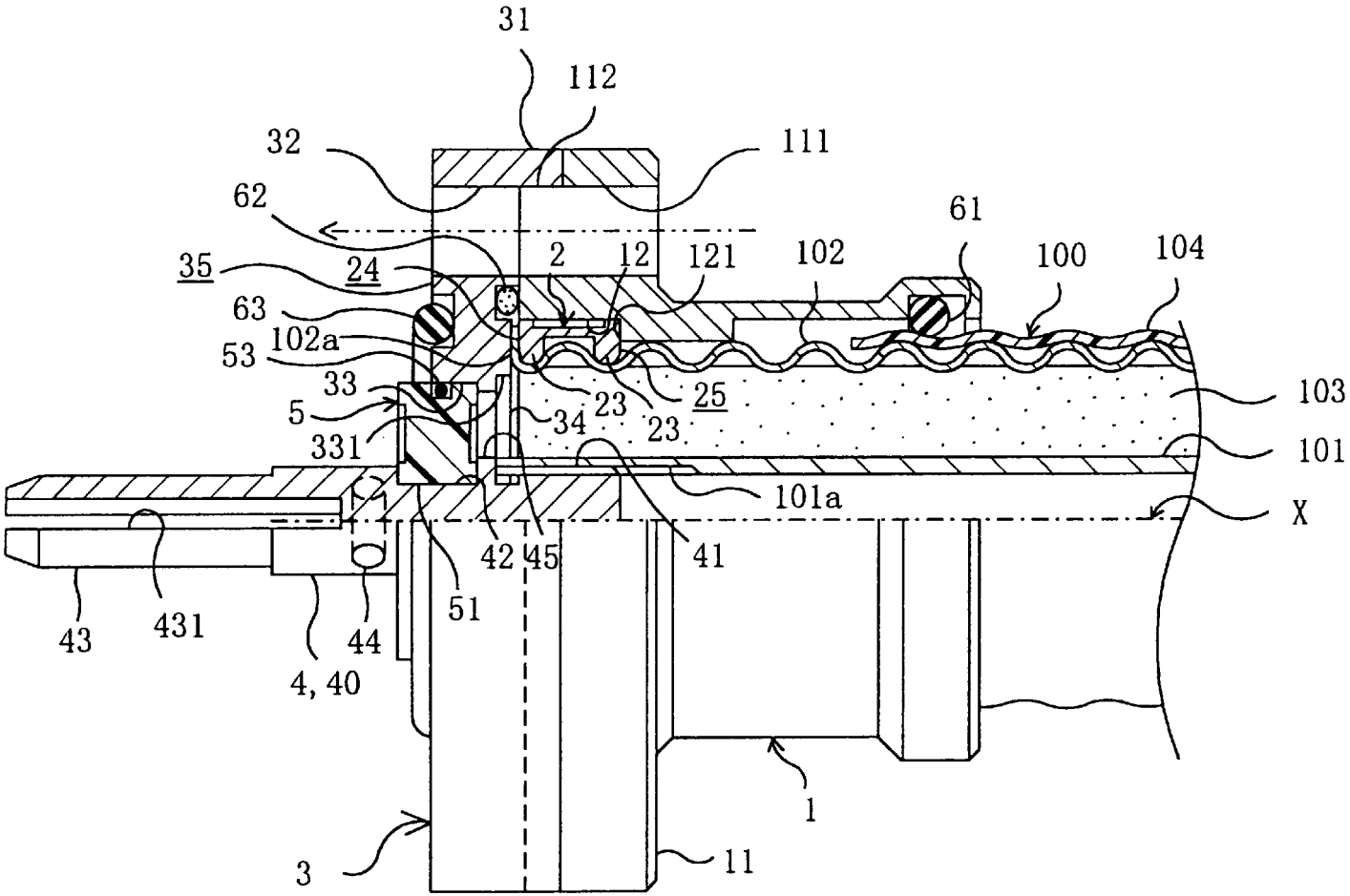
FIG. 1 is a front view with a partly section of the first embodiment of the present invention.
Figure 2:
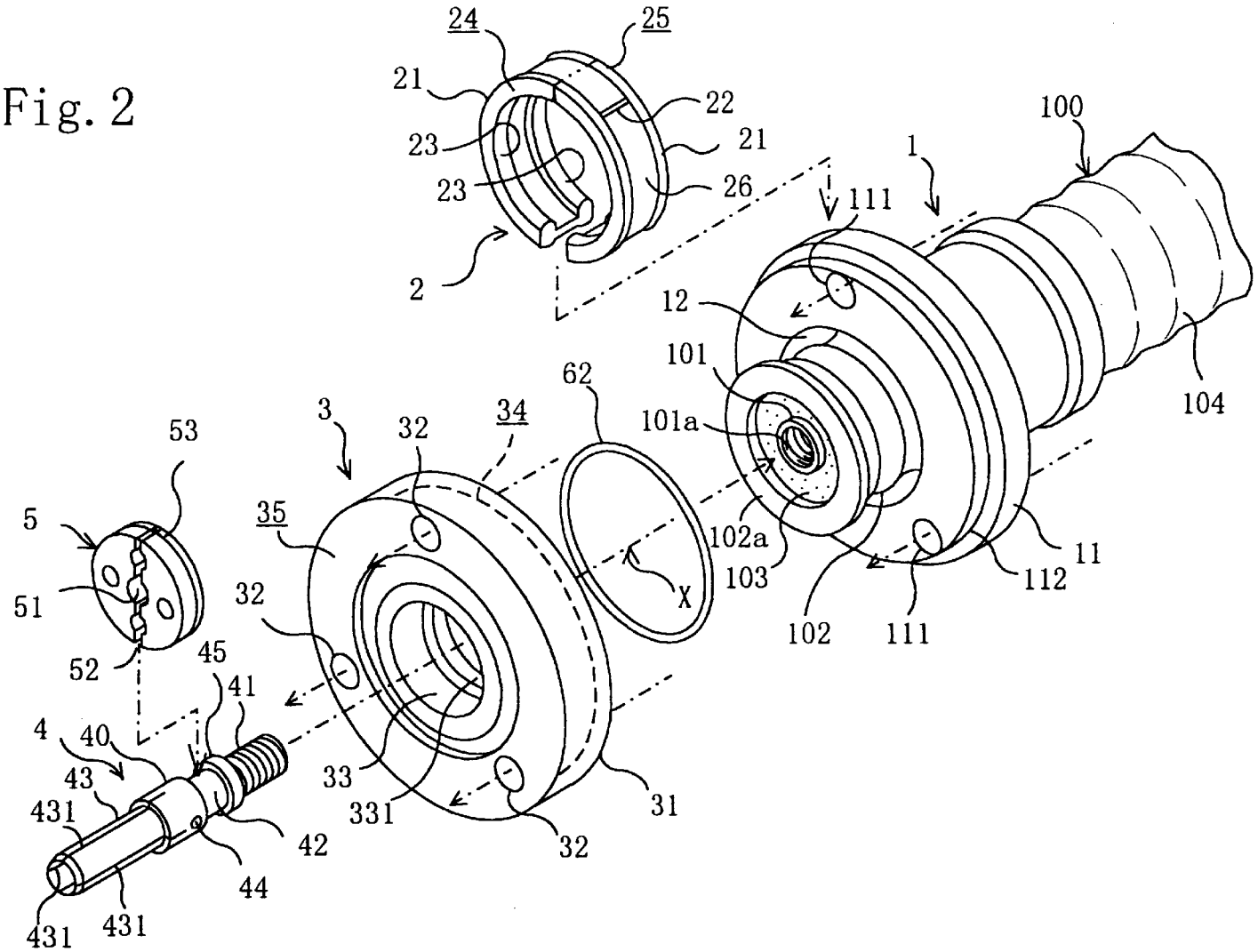
FIG. 2 is an exploded perspective view of the part shown in FIG. 1.

FIGS. 1 and 2 show a connector for a coaxial cable in accordance with the first embodiment of the present invention. The connector is composed of a cylindrical connector main body 1 which is fitted onto the end of a coaxial cable 100 and secured thereto, a split clamp 2 which is attached around the outer surface of the external conductor 102 of the coaxial cable 100 consisting of an annular corrugated tube, a contact spacer 3 which is joined to the tip end surface of the connector main body 1, a bar-like central contact 4 which is fitted into a tubular internal conductor 101 of the coaxial cable 100 in such a manner as to protrude through the inside hole of the contact spacer 3 on the tip side (left side in FIG. 1) in the cable axis X direction, and an annular insulator 5 which insulates the central contact 4 and the contact spacer 3 from each other. The coaxial cable 100 is composed of the tubular internal conductor 101 which extends along the cable axis X, the external conductor 102 which consists of an annular corrugated tube and is placed to be coaxial with the internal conductor 101 a predetermined distance away therefrom by the insulator 103 which covers the internal conductor 101, and a cover layer 104 which covers the outer surface of the external conductor 102. Each of these components will be detailed as follows.

The connector main body 1 is provided with a flange 11 for connection which protrudes outwards in the diameter direction on the tip side in the cable axis X direction, and a fitting concave stage portion 12 formed around the edge of the inner surface of the tip opening. The flange 11 includes a plurality of (three in the drawing) connection holes 111 in the circumferential direction, and a fitting concave portion 112 around the edge of the outer surface. In the fitting concave portion 12, the diameter of the inner circumference is enlarged at the tip opening only for the width of the split clamp 2 in the cable axis X direction, and a stage surface 121 is formed inside so as to extend in a direction orthogonal to the cable axis X. There is an O-ring 61 fitted into the inner surface of the opening of the connector main body 1 on the base end side, so as to seal up the gap between the opening of the connector main body 1 on the base end side and the cover layer 104 of the coaxial cable 100.

The split clamp 2 is provided with a pair of annular members 21 and 21 each divided into semicircles. One end of each annular member 21 is connected with each other by means of an adhesive tape 22 (only shown in FIG. 2). The split clamp 2 is further provided with two inner guard units 23 and 23 formed around the inner surface in such a manner as to conform to the valley behind the flare unit 102*a* of the external conductor 102 and also to another valley adjacent to the valley. These inner guard unit 23 protrude on the inner surface side as far as the outside diameter of these valleys. The split clamp 2 is also provided with the tip end surface 24 and the base end surface 25 both extending in a direction orthogonal to the cable axis X. The split clamp 2 is housed in the concave stage portion 12 with each inner guard unit 23 being fitted into each valley of the external conductor 102. The base end surface 25 comes in contact with the stage surface 121 whereas the tip end surface 24 comes in contact with the back surface of the flare unit 102*a*. In short, the split clamp 2 with the stage surface 121 prevents the flare unit 102*a* of the external conductor 102 from relatively moving inwards in the cable axis X direction (right side in FIG. 1). The split clamp 2 is also provided with a concave portion 26 which has a depth corresponding to the thickness of the adhesive tape 22 and is formed around the outer surface of the split clamp 2.

Figure 6:
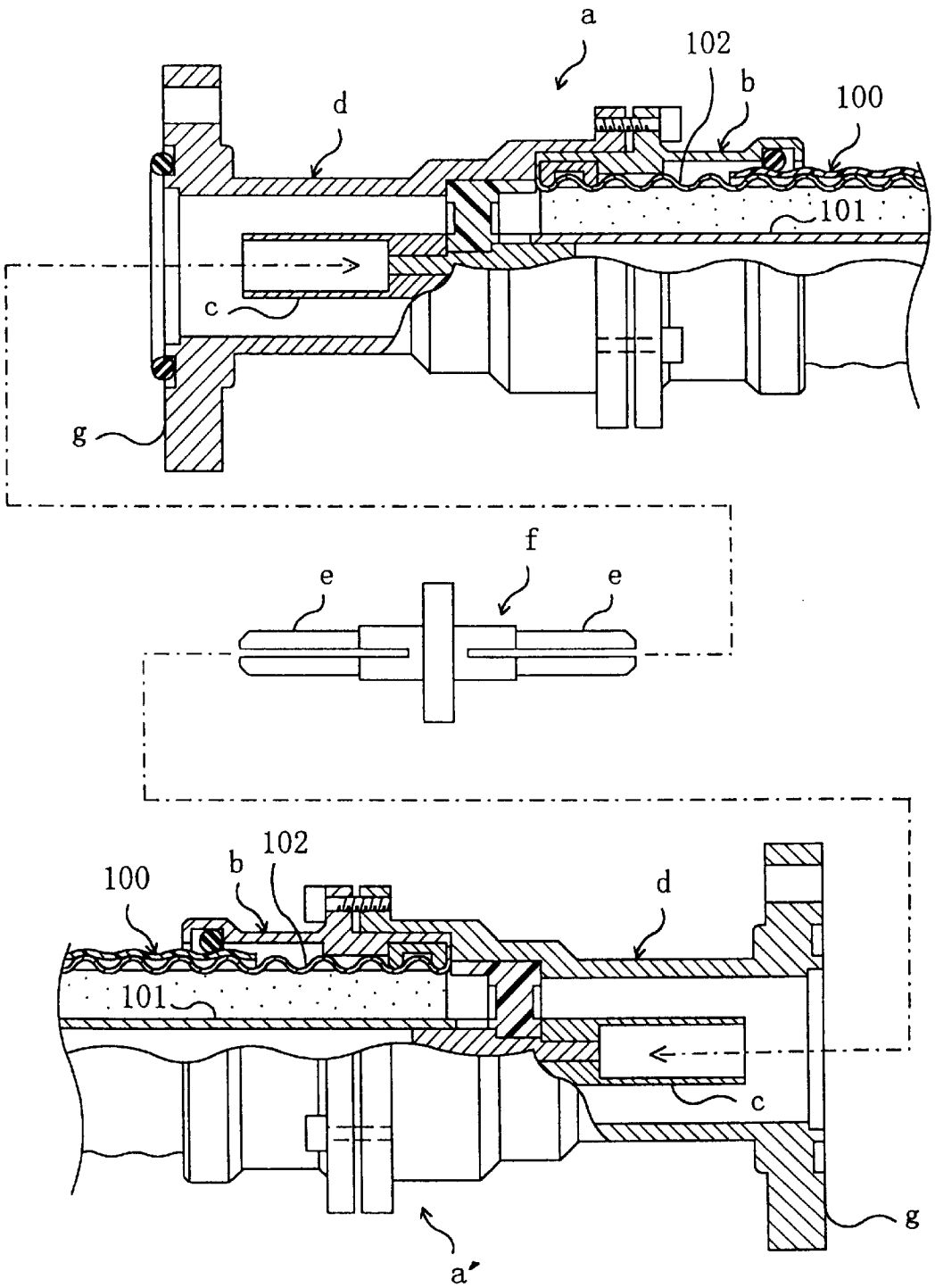
FIG. 6 is a front view with a partly section of conventional connectors and the connection of these connectors shown in an exploded condition.

The contact spacer 3 is in the shape of a relatively thin doughnut plate having the same outside diameter as the flange 11 of the connector main body 1. The contact spacer 3 is provided with an arc convex portion 31 formed around the outer surface in such a manner as to protrude toward the flange 11 and to conform to the fitting concave portion 112. The contact spacer 3 is also provided with the connection holes 32 on the positions which conform to the connection holes 111 of the flange 11. Thus, the contact spacer 3 is pressed tightly against the connector main body 1 by means of unillustrated bolts which go through the connection holes 32, the connection holes 111, and the flange g (refer to FIG. 6) of another type of connector as the connection target and also by means of unillustrated nuts.

The contact spacer 3 includes the inside hole 33 whose inside diameter approximately conforms to the outside diameter of the insulator 5. The inside hole 33 is provided with a stopping unit 331 formed at a predetermined position in the inner part in the cable axis X direction. The stopping unit 331 protrudes inwards in the diameter direction, thereby stopping the insulator 5 from moving inwards. The base end surface 34 of the contact spacer 3 which faces the flare unit 102*a* exposed on the tip side of the connector main body 1 extends in a direction orthogonal to the cable axis X. The front surface of the flare unit 102*a* is contacted and pressed against the base end surface 34 by the screwing force of the volts and nuts. The outer surface of the contact spacer 3 is covered with a layer for corrosion protection such as a nickel-plated layer, and this layer is further covered with a silver-plated layer for forming an electric path. There are an O-ring 62 which seals up the gap between the connector main body 1 and the contact spacer 3, and another O-ring 63 which is fitted into the tip end surface 35 by nearly half of its thickness so as to seal up the gap between the contact spacer 3 and another type of connector as the connection target.

The central contact 4 includes a bar-like main body 40 whose diameter is approximately the same as that of the internal conductor 101. The outer surface of the central contact 4 is covered with the above-mentioned silver-plated layer for forming an electric path. On the base end side in the cable axis X direction, the bar-like main body 40 is provided with a male thread unit 41 having approximately trapezoid lateral cross sections as a connection unit and a guard unit 45. The male thread unit 41 is screwed into a female thread hole 101*a* formed on the tip opening side of the internal conductor 101 through the inside hole 33 of the contact spacer 3, whereas the tip end surface of the internal conductor 101 is pressed against the guard unit 45. In the middle part of the base end side in the cable axis X direction, the bar-like main body 40 is provided with a diameter-reduced unit 42 which lets the insulator 5 fit thereonto. In the tip end part having half the length of the entire bar-like main body 40 in the cable axis X direction, a plurality of grooves 431 are formed crosswise to form an anchor unit 43 as a connection unit. The bar-like main body 40 also includes a pin hole 44 for inserting a pin thereinto so as to rotate the central contact 4 around the cable axis X, thereby screwing the male thread unit 41 into the female thread hole 101*a*.

The insulator 5 is made from polystyrene or the like and in the shape of a disk which consists of a pair of semicircular members. In the center of the facing surfaces 52 where these semicircular members face each other, a fitting hole 51 is formed. The inside diameter of the fitting hole 51 is the same as the outside diameter of the diameter-reduced unit 42. The insulator 5 is so attached to the central contact 4 that the diameter-reduced unit 42 of the central contact 4 is put between the facing surfaces 52, in such a manner as to make the fitting hole 51 fit onto the diameter-reduced unit 42. Under this condition, the pair of semicircular members are temporarily held by a rubber band 53 which is fitted around the outer surface of the insulator 5. Then, the insulator 5 is fitted into the inner surface of the inside hole 33 of the contact spacer 3 and kept from moving by the stopping unit 331. Consequently, the central contact 4 and the contact spacer 3 are insulated from each other whereas half of the width of the insulator 5 in the cable axis X direction protrudes outwards through the tip end surface 35 of the contact spacer 3.

The following is a description of a method for attaching the connector thus constructed to the end of the coaxial cable 100.

Figure 3:
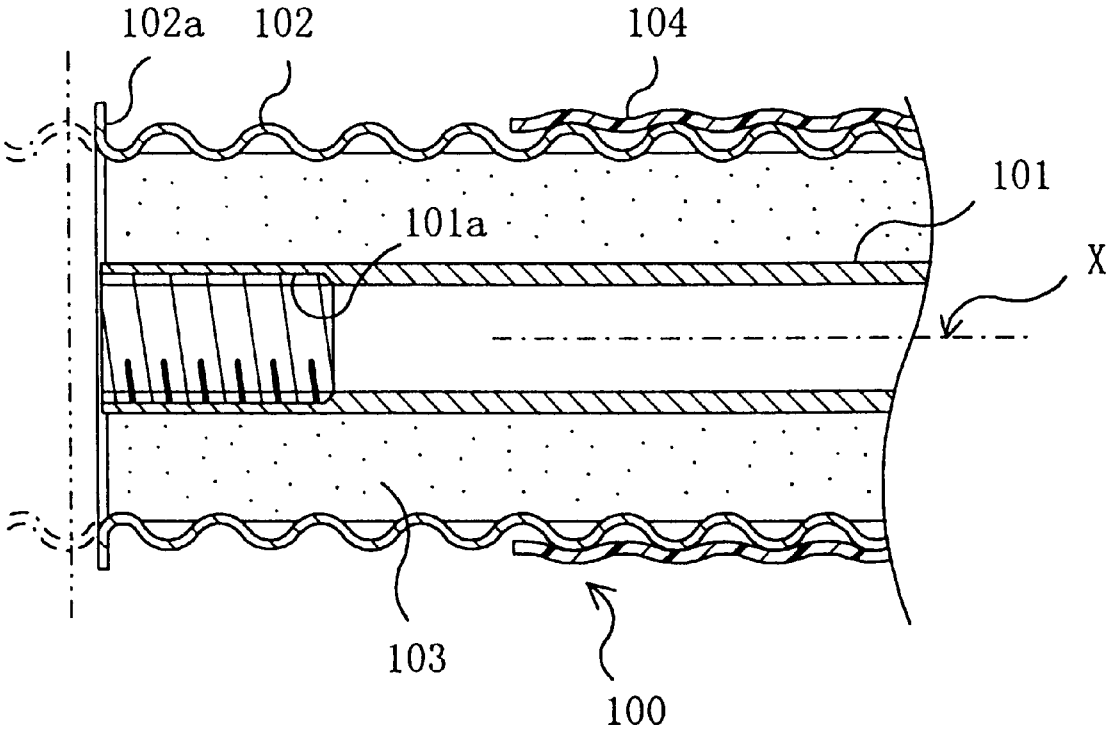
FIG. 3 is a cross sectional view which indicates a method for forming the flare unit shown in FIG. 1.

As a process of the coaxial cable 100 side, the cover layer 104 is cut by a predetermined length from its end, a female thread groove for the female thread hole 101*a* is threaded on the inner surface of the tip opening of the internal conductor 101, the end surface of the insulator 103 is trimmed, and the external conductor 102 is cut at a predetermined position. As shown in FIG. 3, the external conductor 102 is cut at its crest of the corrugation located outside the tip end of the internal conductor 101.

Then, the connector main body 1 is fitted onto the end of the coaxial cable 100 inwards in the cable axis X direction so as to make the end of the coaxial cable 100 protrude through the tip opening of the connector main body 1 by a predetermined length or longer (refer to FIG. 2). Under this condition, the end of the external conductor 102 is folded toward the outer side so as to be extended in a direction orthogonal to the cable axis X, thereby forming the flare unit 102*a*. After the split clamp 2 is fitted immediately behind the flare unit 102*a*, the connector main body 1 is drawn toward the tip of the coaxial cable 100, and the base end surface 25 of the split clamp 2 is pressed against the stage surface 121 of the concave stage portion 12, so as to make the flare unit 102*a* protrude through the tip opening of the connector main body 1 by the thickness of the flare unit 102*a*.

Then, the insulator 5 is fitted onto the diameter-reduced unit 42 of the central contact 4, and the male thread unit 41 of the central contact 4 is inserted into the inside hole 33 of the contact spacer 3 so as to make the outer surface of the insulator 5 fit into the inner surface of the inside hole 33. Under this condition, the male thread unit 41 is screwed into the female thread hole 101*a* of the internal conductor 101 to its root so that the flare unit 102*a* is disposed between the base end surface 34 of the contact spacer 3 and the tip end surface 24 of the split clamp 2, thereby being temporarily secured to the base end surface 34. In this case, the relative positioning of the contact spacer 3 and the connector main body 1 in a direction orthogonal to the cable axis X is automatically carried out when the arc convex portion 31 of the contract spacer 3 is conformed to the fitting concave portion 112 of the connector main body 1. The connection holes 111 of the connector main body 1 and the connection holes 32 of the contact spacer 3 are conformed to each other in the circumferential direction by adjusting the rotation of the contact spacer 3.

Thus, the attachment of the connector to the end of the coaxial cable 100 is completed. After this, the anchor unit 43 of the central contact 4 of this connector is fitted into the tubular central contact c (refer to FIG. 6) of another type of connector a' as the connection target. On the other hand, the flange g of the connector a' and the tip end surface 35 of the contact spacer 3 are joined to each other via the O-ring 63, and the unillustrated connection volts which are inserted into the connection holes 111 and 32 are further inserted into the connection holes of the flange g and tightened with nuts. This tightening makes the flare unit 102*a* be contacted and pressed to the split clamp 2 and the contact spacer 3, and further brings the contact spacer 3 and the flange g of the other connector a' into absolute contact with each other.

Thus, both the coaxial cables 100 are connected with each other at their ends. To be more specific, their internal conductors 101 are electrically connected with each other via the central contact 4 and the central contact c, whereas their external conductors 102 are electrically connected with each other via the contact spacer 3 and the second connection cylinder d.

In the connector of the present embodiment, the conventional anchor connector f (refer to FIG. 6) and the tubular central contact c for letting the anchor connector f fit thereinto are formed as the central contact 4 in one united body. As a result, the length of the entire connector in the cable axis X direction can be greatly reduced as compared with the conventional connector a, which realizes a drastic miniaturization. This achieves cost reduction and facilitation of the handling and storing the connector. Furthermore, the omission of the conventional anchor connector f results in a decrease in the number of electrical contact points between the internal conductors 101, thereby improving the electrically continuity performance of the connector connection parts.

Furthermore, the flare unit 102*a* which expands in a direction orthogonal to the cable axis X is pressed against the contact spacer 3 by being disposed between the tip end surface 24 of the split clamp 2 and the base end surface 34 of the contact spacer 3 both of which also expand in the direction orthogonal to the cable axis X. Consequently, it is secured to make the flare unit 102*a* be contacted and pressed to the contact spacer 3 even if the relative position between the connector main body 1 and the coaxial cable 100 is slightly eccentric or slanted against the cable axis X. As a result, the electric connection between the external conductor 102 and the contact spacer 3 can be secured.

Since the ridges of the male thread unit 41 of the central contact 4 have a trapezoid lateral cross section, the female thread groove for the female thread hole 101*a* of the internal conductor 101 can be relatively shallow. Consequently, the thread chasing can be simplified and the fear of the internal conductor 101 damaging is eliminated.

<Embodiment 2>

Figure 4:
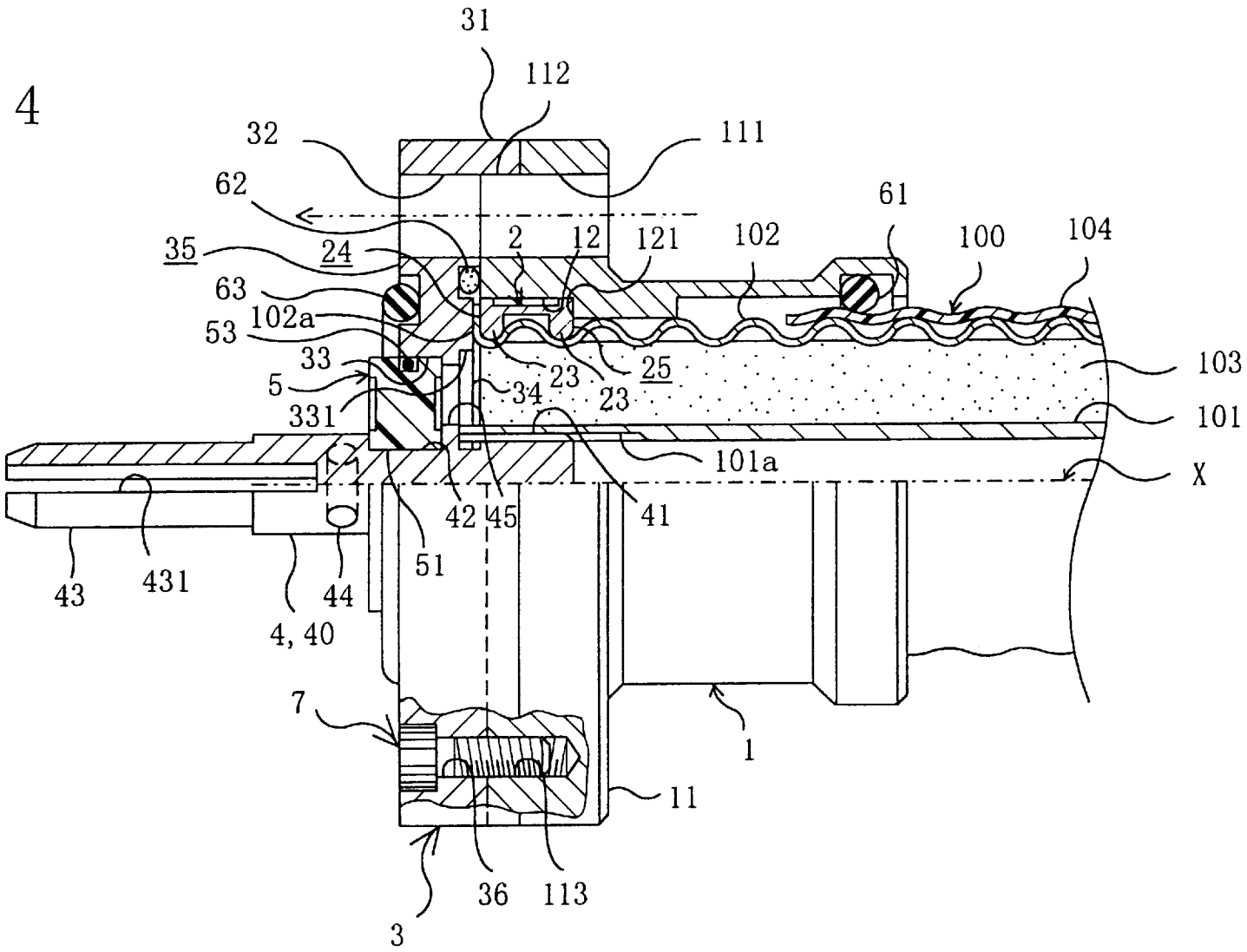
FIG. 4 is a front view with a partly section of the second embodiment.
Figure 5:
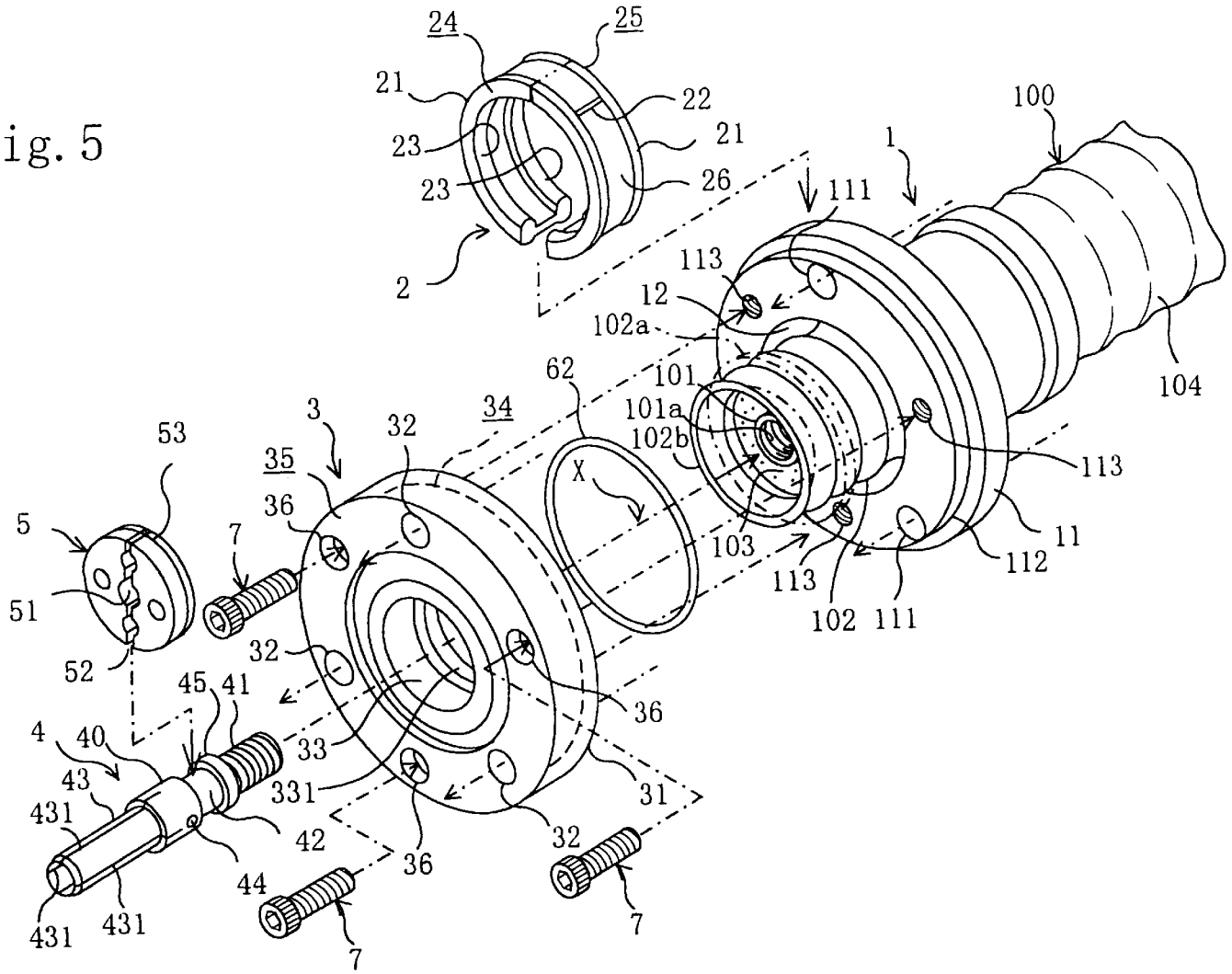
FIG. 5 is an exploded perspective view of the part shown in FIG. 4.

FIGS. 4 and 5 show the second embodiment. The second embodiment has the same construction as the first embodiment except that a plurality of (three in the drawings) hexagon socket head cap screws 7, 7, and 7 are added as a connection means for joining the flange 11 of the connector main body 1 and the contact spacer 3 to each other.

The flange 11 includes three attachment holes 113, 113, and 113 into which each hexagon socket head cap screw 7 made from stainless steel or the like is screwed. Each attachment hole 113 has an opening at least on the contact spacer 3 side and is formed in a different position from the connection holes 111 in the circumference direction. On the inner surface of each attachment hole 113, a female thread is formed into which each hexagon socket head cap screw 7 is screwed.

The contact spacer 3 includes three through holes 36, 36, and 36 in the cable axis X direction in predetermined positions apart from each other in the circumference direction. Each through hole 36 is formed in a position which conforms to a corresponding attachment hole 113 when the connection holes 111 of the flange 11 and the connection holes 32 of the contact spacer 3 are conformed to each other in the cable axis X direction. The diameter of each through hole 36 is enlarged on the tip end surface 35 side of the contact spacer 3 so that the whole head of each hexagon socket head cap screw 7 can be fitted inside. When the whole head of each hexagon socket head cap screw 7 is fitted into the enlarged portion of the through hole 36 (refer to FIG. 4), the end surface of the head and the tip end surface 35 are supposed to be even.

The following is a brief description of a method for attaching the connector of the second embodiment to the end of the coaxial cable 100. After the process of the coaxial cable 100 side is carried out in the same manner as in the first embodiment, the connector main body 1 is fitted onto the end of the coaxial cable 100 inwards in the cable axis X direction so as to make the end of the coaxial cable 100 protrude through the tip opening of the connector main body 1 by a predetermined length or longer (refer to FIG. 2) in the same manner as in the first embodiment. To be more specific, as the process of the coaxial cable 100 side, the cover layer 104 is cut by a predetermined length from its end, a female thread groove for the female thread hole 101*a* is threaded on the inner surface of the tip opening of the internal conductor 101, the end surface of the insulator 103 is trimmed, and the external conductor 102 is cut at a predetermined position. As shown in FIG. 3, the external conductor 102 is cut at its vertex of crest of the corrugation located outside the tip end of the internal conductor 101 in the same manner as in the first embodiment.

In the first embodiment the flare unit 102*a* (refer to FIG. 2) is formed by bending the edge 102*b* of the external conductor 102; however, in the second embodiment, instead of forming the flare unit 102*a*, the split clamp 2 is fitted onto the outer surface of the edge 102*b* which is formed by cutting the crest of the ridge. Then, the connector main body 1 is drawn toward the tip of the coaxial cable 100, and the base end surface 25 of the split clamp 2 is pressed against the stage surface 121 of the concave stage portion 12, so as to make the edge 102*b* protrude through the tip opening of the connector main body 1 (the tip end surface 24 of the split clamp 2).

The three hexagon socket head cap screws 7 are screwed into the corresponding attachment holes 113 of the connector main body 1 through the through holes 36 under a condition where the base end surface 34 of the contact spacer 3 is faced with the connector main body 1, and the edge 102*b* of the external conductor 102 is disposed between the tip end surface 24 of the split clamp 2 and the base end surface 34 of the contact spacer 3. With this screwing, the edge 102*b* of the external conductor 102 is folded on the outer side along the tip end surface 24 of the split clamp 2 in response to the screwing pressure from each hexagon socket head cap screw 7. Finally, the same flare unit 102*a* as in the first embodiment is formed and disposed between the base end surface 34 of the contact spacer 3 and the tip surface 24 of the split clamp 2, thereby being contacted and pressed to the base end surface 34. At the same time, by the screwing of each hexagon socket head cap screw 7, the connector main body 1 and the contact spacer 3 are tightly united with each other, and each connection hole 111 of the connector main body 1 and a corresponding connection hole 32 of the contact spacer 3 are aligned in the cable axis X direction. During the screwing, the relative positioning of the contact spacer 3 and the connector main body 1 in a direction orthogonal to the cable axis X is automatically carried out when the arc convex portion 31 of the contract spacer 3 is conformed to the fitting concave portion 112 of the connector main body 1.

Finally, the central contact 4 is attached to the internal conductor 101 as follows. First of all, the insulator 5 is fitted onto the diameter-reduced unit 42 of the central contact 4, and the male thread unit 41 of the central contact 4 is inserted into the inside hole 33 of the contact spacer 3 so as to make the outer surface of the insulator 5 fit into the inner surface of the inside hole 33. Under this condition, the male thread unit 41 is screwed into the female thread hole 101*a* of the internal conductor 101 to its root.

Thus, the attachment of the connector to the coaxial cable 100 is completed. After this, the connector is connected with another type of connector a' (refer to FIG. 6) as the connection target in the same manner as in the first embodiment, so that both the coaxial cables 100 are connected with each other at their ends. To be more specific, their internal conductors 101 are electrically connected with each other via the central contact 4 and the central contact c, whereas their external conductors 102 are electrically connected with each other via the contact spacer 3 and the second connection cylinder d.

In addition to the same effects as the first embodiment, the connector of the second embodiment has the following effects: In the first embodiment before the connector is joined to another connector by inserting the unillustrated connection bolts through the connection holes 111 and 32, the connector main body 1 and the contact spacer 3 are temporarily connected with each other by screwing the central contact 4 into the internal conductor 101. As a result, the flare unit 102*a* of the external conductor 102 is temporarily touched to the base end surface 34 of the contact spacer 3. In contrast, in the second embodiment the connector main body 1 and the contact spacer 3 are tightly united with each other by the screwing of each hexagon socket head cap screw 7. Consequently, the flare unit 102*a* is kept to be contacted and pressed to the base end surface 34 of the contact spacer 3. For this reason, in the second embodiment it becomes possible to attach the connector to the end of the coaxial cable 100 in a firmly united condition, and to ship it as an integrated product. Furthermore, the electric connections between the internal conductor 101 and the central contact 4 and between the external conductor 102 and the contact spacer 3 are secured because the unity of the whole connector is not damaged even if the connector suffers a shock during transportation before it is connected with another connector after shipment. Thus, the reliability as a product can be enhanced.

In addition, in the process of joining the connector to the coaxial cable 100, the screwing of each hexagon socket head cap screw 7 makes it possible not only to combine the contact spacer 3 and the connector main body 1 in one piece, but also to form the flare unit 102*a* at the same time. Consequently, the process of forming the flare unit 102*a* can be omitted in the process of trimming the end of the coaxial cable 100. Furthermore, in the process of connecting the connector of the present embodiment to another connector, operations such as additional tightening of the central contact 4 can be omitted because the connector side of the present embodiment is already integrated. Thus, a connection with a fixed quality can be realized.

<Other embodiments>

The present invention is not restricted to the first and the second embodiments but includes other embodiments. That is, in the first and second embodiments the flare unit 102*a* is contacted and pressed to the contact spacer 3 by using the split clamp 2; however, as another method, the end surface of the connector main body 1 on the tip opening side may be in contact with the back surface of the flare unit 102*a* so that the flare unit 102*a* is contacted and pressed to the contact spacer 3.

Although the first and second embodiments are intended for the coaxial cable 100 with the tubular internal conductor 101, a coaxial cable with a solid-core rod-like internal conductor may be used instead. In this case, a male thread unit is formed at the tip of the rod-like internal conductor, and the connection part of the central contact 4 may be a female thread hole for letting the male thread unit screw thereinto.

In the first and second embodiments, the arc convex portion 31 is formed on the contact spacer 3 and the fitting concave portion 112 is formed on the connector main body 1; however, it is possible to do it the other way around and to form the arc convex portion on the connector main body 1 and to form the fitting concave portion on the contact spacer 3. Furthermore, the combination of the arc convex portion 31 and the fitting concave portion 112 may be formed only in a part of the surface edge in the circumferential direction instead of being formed throughout the surface edge, or may be formed in the center of the surface where the contact spacer 3 and the connector main body 1 face each other, instead of being formed on the outer surface edge.

Each hexagon socket head cap screw 7 is screwed into the connector main body 1 from the contact spacer 3 side in the second embodiment; however, it may be screwed into the contact spacer 3 from the connector main body 1 side. The flange 11 of the connector main body 1 is provided with the attachment holes 113 each having a thread groove in the second embodiment; however, it is possible to make each screw 7 go through the flange 11 and be tightened with nuts. Three hexagon socket head cap screws 7 are used as a connection means in the second embodiment; however, two or more than three such screws may be used, as long as the flare unit 102*a* can be formed by uniting the contact spacer 3 and the connector main body 1. Normal hexagon head bolts may be used in place of the hexagon socket head cap screws, or other means than bolts can be used.

Screwing each hexagon socket head cap screw 7 into the connector main body 1 from the contact spacer 3 side enables the contact spacer 3 and the connector main body 1 to be united, and also realizes the formation of the flare unit 102*a* in the second embodiment. Instead of this, it is possible to previously form the flare unit 102*a* when the end of the coaxial cable 100 is fixed, like in the first embodiment.

What is claimed is:

1. A connector for a coaxial cable including an internal conductor and an external conductor, the external conductor having a corrugated outer surface, the connector comprising:

a connector main body including a cylindrical body having a first inner hole, one end of the coaxial cable being secured within the first inner hole, the connector main body being electrically connected to the external conductor of the coaxial cable;

a contact spacer including a doughnut plate-shaped body having a second inner hole with a smaller diameter than that of the first inner hole, the doughnut plate-shaped body being in contact with the external conductor at the one end of the coaxial cable, the contact spacer being electrically connected to the external conductor; and a central contact including a bar-shaped body, the central contact being insulated from the connector main body and the contact spacer, one end of the bar-shaped body protruding outwards from the second inner hole of the contact spacer in the axis direction of the coaxial cable, the other end of the bar-shaped body being in contact with the internal conductor at the one end of the coaxial cable, the central contact being electrically connected to the internal conductor.

2. The connector of claim 1, further comprising a split clamp provided around the one end of the coaxial cable within the first hole of the connector main body, the split clamp including:

an inner surface having two guard members protruding inwardly to the center of the first hole and ensuring electrical contact with the external conductor at the one end of the coaxial cable;

an outer surface ensuring electrical contact with an inner surface of the connector main body; and base and tip end surfaces both substantially orthogonal to the axis direction of the coaxial cable, the base surface being in contact with the inner surface of the connector main body, the one end of the external conductor being interposed between the tip end surface and the doughnut plate-shaped body.

3. The connector of claim 1, further comprising an annular insulator within the second hole of the contact spacer, wherein the annular insulator is provided between the central contact and the contact spacer to insulate the central contact from the contact spacer.

4. The connector claim 1, wherein the other end of the bar-shaped body of the central contact is threaded into the internal conductor at the one end of the coaxial cable.

5. The connector of claim 1, wherein the connector main body further includes a flange extending orthogonal to the axis direction of the coaxial cable, the flange and the contact spacer having a first contact surface and a second contact surface, respectively, the first and second contact surfaces respectively having concave and convex portions, or vice versa, and wherein the connector main body and the contact spacer are in contact with each other at the first and second contact surfaces such that the concave and convex portions of the first and second contact surfaces are engaged with each other to position the contact spacer relative to the connector main body in a direction orthogonal to the axis direction of the coaxial cable.

6. The connector of claim 5, further comprising connection means for joining the flange of the connector main body and the contact spacer to each other.

7. The connector of claim 5, wherein the connector main body has first connection holes in the flange and the contact spacer has second connection holes in the doughnut plate-shaped body, the contact spacer and the connector main body being fixed to each other by bolts and nuts through the first and second connection holes.

8. The connector of claim 5, wherein the connector main body has first connection holes in the flange and the contact spacer has second connection holes in the doughnut plate-shaped body, the first and second connection holes together forming female thread holes, the connector main body and the contact spacer being fixed to each other by male thread units screwed into the female thread holes.

* * * * *